US010046386B2

(12) United States Patent
Stone et al.

(10) Patent No.: US 10,046,386 B2
(45) Date of Patent: Aug. 14, 2018

(54) DEVICE FOR CASTING

(71) Applicant: Ashley Stone, Washago (CA)

(72) Inventors: Ashley Stone, Washago (CA); Martin R. Kestle, Everett (CA)

( * ) Notice: Subject to any disclaimer, the term of this patent is extended or adjusted under 35 U.S.C. 154(b) by 162 days.

(21) Appl. No.: 14/695,927

(22) Filed: Apr. 24, 2015

(65) Prior Publication Data

US 2015/0266086 A1 Sep. 24, 2015

Related U.S. Application Data

(63) Continuation of application No. 13/910,800, filed on Jun. 5, 2013, which is a continuation of application No. 13/103,743, filed on May 9, 2011, which is a continuation of application No. 12/098,368, filed on Apr. 7, 2008.

(60) Provisional application No. 60/935,561, filed on Aug. 20, 2007, provisional application No. 60/907,533, filed on Apr. 6, 2007.

(51) Int. Cl.

| | |
|---|---|
| ***B22D 17/04*** | (2006.01) |
| ***B22D 17/20*** | (2006.01) |
| ***B22D 17/00*** | (2006.01) |
| ***B22D 45/00*** | (2006.01) |

(52) U.S. Cl.

CPC ..... *B22D 17/04* (2013.01); *B22D 17/007* (2013.01); *B22D 17/20* (2013.01); *B22D 17/203* (2013.01); *B22D 17/2038* (2013.01); *B22D 45/00* (2013.01)

(58) Field of Classification Search

CPC ..... B22D 17/007; B22D 17/02; B22D 17/04; B22D 17/2038; B22D 17/2061

See application file for complete search history.

(56) References Cited

U.S. PATENT DOCUMENTS

| | | | |
|---|---|---|---|
| 2,195,360 | A | 3/1940 | Daesen |
| 2,262,615 | A | 11/1941 | Lester |
| 2,269,388 | A | 1/1942 | Weida |
| 2,582,260 | A | 1/1952 | Kutik |
| 3,431,600 | A | 3/1969 | Bullard |
| 3,620,686 | A | 11/1971 | Pfann |
| 3,669,180 | A | 6/1972 | Moore |
| 3,780,764 | A | 12/1973 | Geist |

(Continued)

FOREIGN PATENT DOCUMENTS

| | | |
|---|---|---|
| JP | 5-285626 | 11/1993 |
| JP | 5-285627 | 11/1993 |

OTHER PUBLICATIONS

Hodiamont, S.; European Search Report from corresponding EP Application No. 09004312.6; search completed on Jul. 16, 2009.

*Primary Examiner* — Kevin E Yoon
*Assistant Examiner* — Jacky Yuen

(57) ABSTRACT

The present invention is a casting machine for casting parts in a mold out of a metal using a metal feedstock. The machine feeds solid metal feedstock into a processing cylinder formed in a thermally conductive block and a heater elevates the temperature of the feedstock as it passes along the said processing cylinder first and second ends, the first end of the processing cylinder being configured to receive. The feedstock becomes more liquid and is transferred to an injector cylinder formed in the thermally conductive block adjacent the processing cylinder. The injector cylinder has a shooting pot coupled to the second end of the processing cylinder by a passage configured to permit feedstock to pass from the processing cylinder into the shooting pot from where is it injected into a mold.

21 Claims, 16 Drawing Sheets

(56) References Cited

U.S. PATENT DOCUMENTS

| | | | |
|---|---|---|---|
| 3,902,544 | A | 9/1975 | Flemings |
| 3,937,610 | A | 2/1976 | Farrell |
| 3,976,118 | A | 8/1976 | Khan |
| 4,019,560 | A | 4/1977 | Gruner |
| 4,083,478 | A | 4/1978 | McLane |
| 4,088,178 | A | 5/1978 | Ueno |
| 4,209,321 | A | 6/1980 | Harvey |
| 4,260,359 | A | 4/1981 | Dannels |
| 4,347,889 | A | 9/1982 | Komatsu |
| 4,399,859 | A | 8/1983 | Marcil |
| 4,430,116 | A | 2/1984 | Yamazaki et al. |
| 4,519,436 | A | 5/1985 | Ebisawa |
| 4,632,283 | A | 12/1986 | Arakawa |
| 4,694,881 | A | 9/1987 | Busk |
| 4,804,167 | A | 2/1989 | Kock et al. |
| 4,828,460 | A | 5/1989 | Saito |
| 4,828,769 | A | 5/1989 | Maus |
| 5,040,589 | A | 8/1991 | Bradley |
| 5,052,468 | A | 10/1991 | Koenig |
| 5,056,687 | A | 10/1991 | Claassen |
| 5,067,893 | A | 11/1991 | Osuna-Diaz |
| 5,109,914 | A | 5/1992 | Kidd |
| 5,154,875 | A | 10/1992 | Luchs |
| 5,207,266 | A | 5/1993 | Nakashima |
| 5,244,033 | A | 9/1993 | Veno |
| 5,280,757 | A | 1/1994 | Carter et al. |
| 5,299,626 | A | 4/1994 | Iwamoto |
| 5,385,601 | A | 1/1995 | Kemeny et al. |
| 5,388,633 | A | 2/1995 | Mercer |
| 5,472,039 | A | 12/1995 | Schwab |
| 5,501,266 | A | 3/1996 | Wang et al. |
| 5,543,105 | A | 8/1996 | Stummer |
| 5,685,357 | A | 11/1997 | Kato |
| 5,699,849 | A | 12/1997 | Fink |
| 5,718,117 | A | 2/1998 | McDunn |
| 5,735,333 | A | 4/1998 | Nagawa |
| 5,819,839 | A | 10/1998 | Mihelich |
| 5,826,518 | A | 10/1998 | Bnhat et al. |
| 5,934,521 | A | 8/1999 | Yamada |
| 5,960,854 | A | 10/1999 | Fink |
| 5,964,413 | A | 10/1999 | Mok |
| 5,983,976 | A | 11/1999 | Kono |
| 5,983,978 | A | 11/1999 | Vining |
| 5,996,679 | A | 12/1999 | Pinnow |
| 6,050,323 | A | 4/2000 | Seoll |
| 6,059,012 | A | 5/2000 | Vinning et al. |
| 6,065,526 | A | 5/2000 | Kono |
| 6,135,196 | A | 10/2000 | Kono |
| 6,214,478 | B1 | 4/2001 | Soell |
| 6,241,001 | B1 | 6/2001 | Kono |
| 6,273,308 | B1 | 8/2001 | Choshi |
| 6,299,665 | B1 | 10/2001 | LeBeau |
| 6,470,955 | B1 | 10/2002 | Richard |
| 6,474,399 | B2 | 11/2002 | Kono |
| 6,478,075 | B1 | 11/2002 | Shibata |
| 6,498,725 | B2 | 12/2002 | Cole |
| 6,546,991 | B2 | 4/2003 | Dworog et al. |
| 6,619,370 | B2 | 9/2003 | Sakamoto |
| 6,739,379 | B2 | 5/2004 | Kono |
| 6,805,189 | B2 | 10/2004 | Ervin |
| 6,808,004 | B2 | 10/2004 | Kamm |
| 6,855,183 | B1 | 2/2005 | Pierc, Jr. |
| 6,932,938 | B2 | 8/2005 | Norville |
| 6,942,006 | B2 | 9/2005 | Kono |
| 6,945,769 | B2 | 9/2005 | Deaville |
| 6,951,238 | B2 | 10/2005 | Hirai |
| 6,997,231 | B1 | 2/2006 | Jung |
| 7,004,225 | B2 | 2/2006 | Takizawa |
| 7,017,649 | B2 | 3/2006 | Kubota |
| 7,040,377 | B2 | 5/2006 | Toyoshima |
| 7,066,236 | B2 | 6/2006 | Fujikawa |
| 7,150,308 | B2 | 12/2006 | Hirai |
| 7,163,046 | B2 | 1/2007 | Tanaka |
| 7,234,505 | B2 | 6/2007 | Murray |
| 7,252,501 | B2 | 8/2007 | Pruden |
| 7,291,008 | B2 | 11/2007 | Habibi-Naini |
| 7,942,951 | B2 | 5/2011 | Johnsgard et al. |
| 2001/0004931 | A1 | 6/2001 | Koda |
| 2001/0052405 | A1 | 12/2001 | Takizawa |
| 2002/0017165 | A1 | 2/2002 | LeBeau |
| 2002/0017371 | A1 | 2/2002 | Sakamoto |
| 2002/0029658 | A1 | 3/2002 | LeBeau |
| 2002/0124988 | A1 | 9/2002 | Takizawa et al. |
| 2003/0024682 | A1 | 2/2003 | Tsuchya et al. |
| 2004/0000386 | A1 | 1/2004 | Nakao |
| 2004/0099400 | A1 | 5/2004 | Tsuzuki |
| 2004/0182536 | A1 | 9/2004 | Takizawa |
| 2005/0167070 | A1 | 8/2005 | Plotz |
| 2005/0280186 | A1 | 12/2005 | Fairy |
| 2006/0243416 | A1 | 11/2006 | Manda |
| 2006/0255095 | A1 | 11/2006 | Taniguchi |

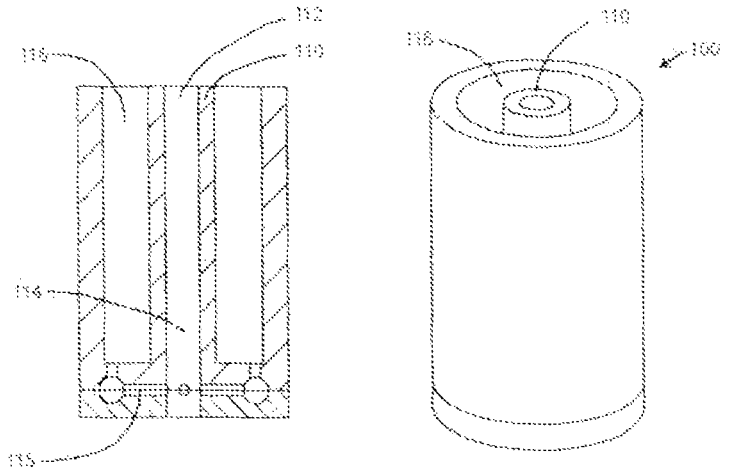
Fig. 10 Concentric structure of processing barrel (right) and sectional view (left)
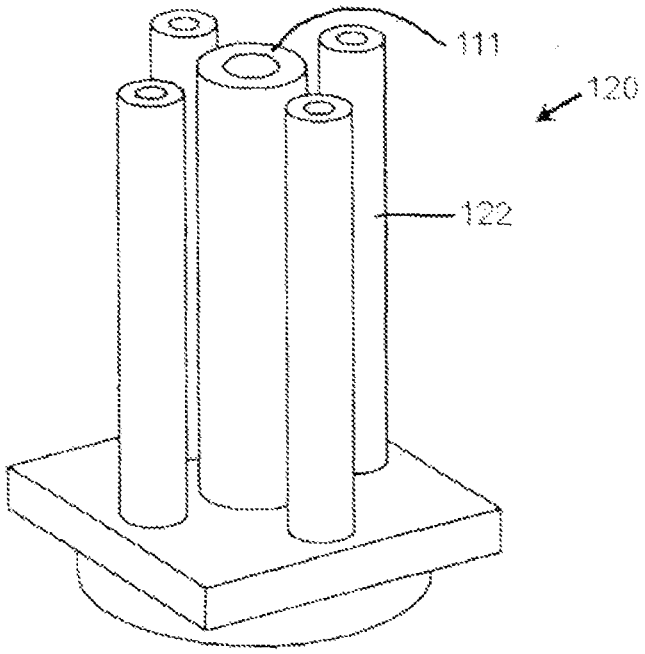
Fig. 11 Processing barrel with external stuffer cavities

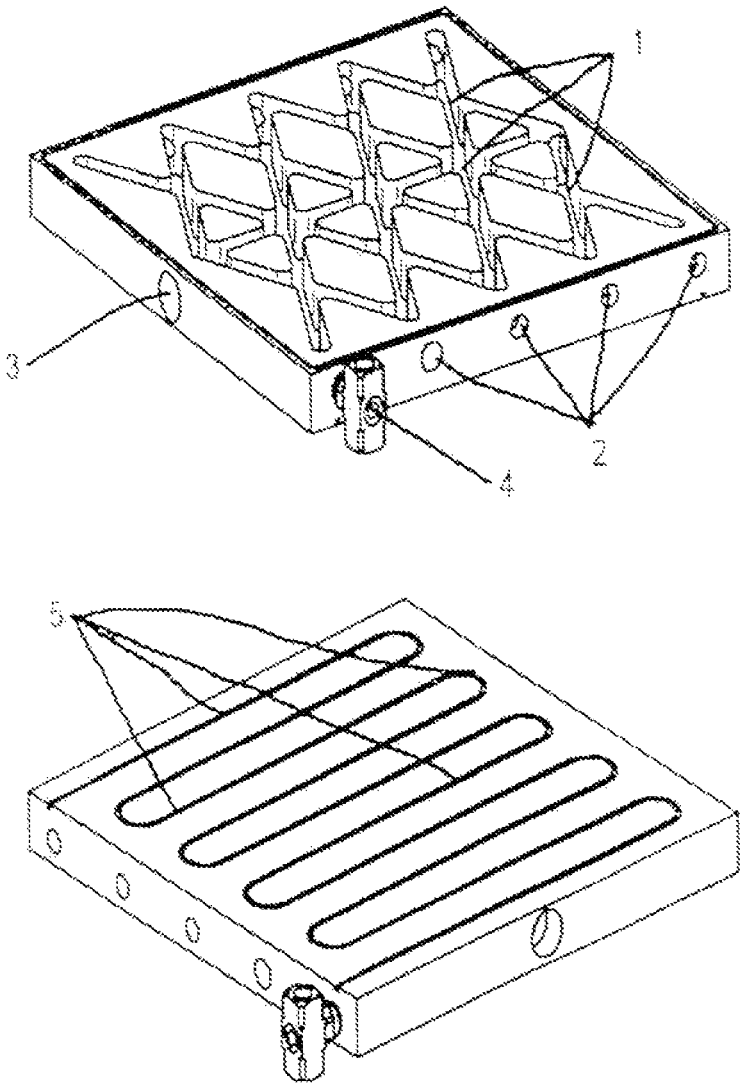
Fig. 13 Mold cooling/heating plates

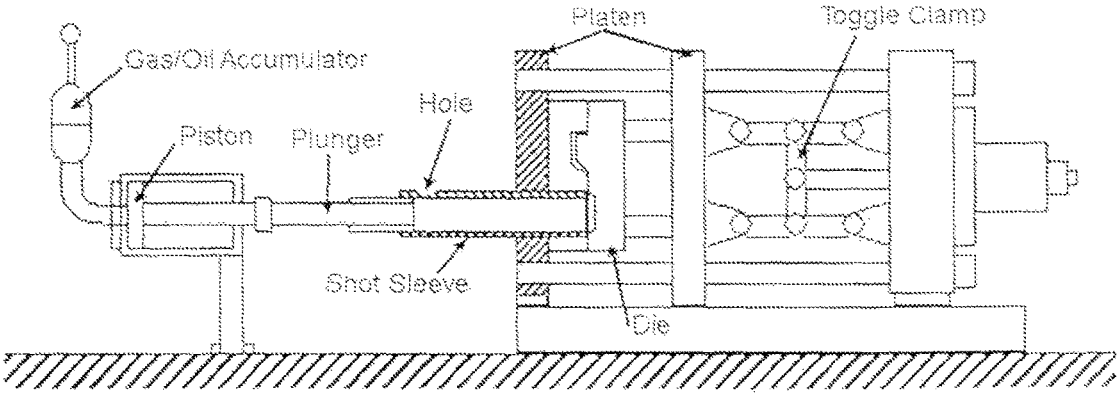
Fig. 14 Cold Chamber Die Casting Machine (Prior Art)

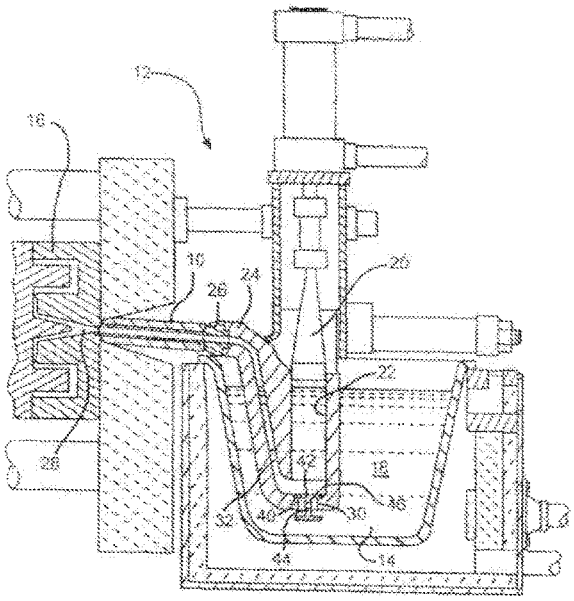
Fig. 15 Hot Chamber Die Casting Machine (Prior Art)
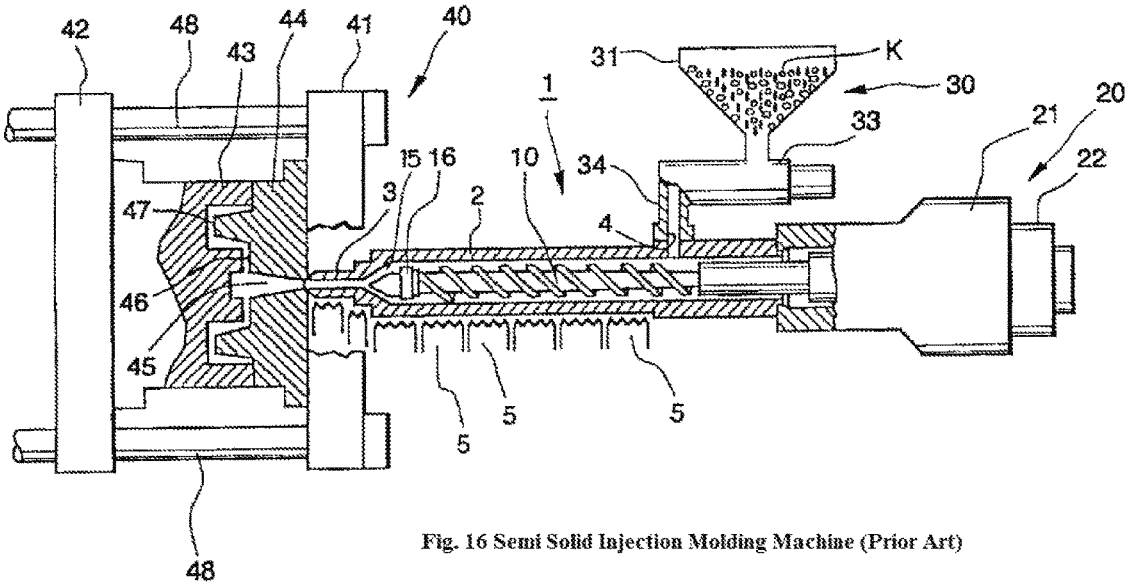
Fig. 16 Semi Solid Injection Molding Machine (Prior Art)

DEVICE FOR CASTING

CROSS REFERENCE TO RELATED APPLICATIONS

This application is a continuation of U.S. application Ser. No. 13/910,800 filed Jun. 5, 2013, which is a continuation of U.S. application Ser. No. 13/103,743 filed May 9, 2011 which is a continuation of U.S. application Ser. No. 12/098,368 filed on Apr. 4, 2008 which claims priority from U.S. Provisional Application No. 60/907,533 filed on Apr. 6, 2007 and U.S. Provisional Application No. 60/935,561 filed on Aug. 20, 2007, all of which are incorporated herein by reference.

FIELD OF THE INVENTION

The invention relates generally to devices for casting or molding parts.

BACKGROUND OF THE INVENTION

It is a trend to increase the strength and reduce the weight of all kinds of transportation vehicles (bikes, motorbikes, cars, trucks, aircraft, space shuttle and others). With reduced weight, reduced fuel consumption and reduced gas emissions to follow. Today, automobile manufacturers are using more and more plastics, but plastic's strength to weight ratio is low when compared to light metals like aluminum, and in particular magnesium. Plastic also has the disadvantage of being difficult to recycle and separate it from other materials in automobiles. Light alloy parts in cars are easy to separate for recycling and materials are generally environmentally friendly with lower energy impact.

Prior art in the field of light alloy castings is based on the premise that a melting pot is required for melting material, after which the molten material is transported into the die-casting machine. Basically, in prior art, the die-casting process is accomplished by melting material in big pot, transferring the material into a machine (manually or by robot) and injecting this molten material into a cavity with high force and low to high speed. Considering the fact that in prior art molten material resides in a big pot, it is a requirement of the process that the molten material is overheated (superheated). For magnesium this melt temperature is 700°-780° C. Superheated melting is done to overcome cooling losses encountered in the process of melt transfer from pot to the die-casting machine. Intense energy requirements for this process are a major drawback for this technology. Furthermore, handling the melt in the manufacturing process is riddled with losses and melt contamination. Intense oxidation of the melt results in poor castings. Injection of material into the cavity requires high speed, and turbulence from the process often results in extensive inclusions in the castings. Defects of this nature are detrimental for applications in the automotive industry, particularly for castings related to vehicle safety. From the above brief description of the current state of the art we can see a need for more efficient machines that will reduce energy consumption to a minimum and totally eliminate Green House Gas (GHG) use.

Die-casting is a manufacturing process used to produce a part in near-net shape with high dimensional accuracy and a good surface finish in a short cycle time. The casting industry branched in two directions: Melt processing, where hot and cold chamber casting dominate, and semi solid slurry processing where Rheomolding and Thixomolding® routes have been adopted. Cornell research foundation's U.S. Pat. No. 5,501,266 discloses a process called Rheomolding. Superheated liquid metal supplied from outside is cooled into a semi-solid state in the barrel of a special vertical-injection molding machine, with the growing dendrites of the solid state broken into small and nearly spherical particles by the shearing force generated by the screw and barrel. It was said that this process can produce net-shape metal parts at a lower cost but this has not been the case under real market conditions. These machines are very expensive and complex, difficult to operate and support. The Rheomolding route has not been often used. The Thixomolding® route, also known as semi-solid casting or molding (as terms used in the plastics industry) has been more widely adopted.

Conventional die casting apparatuses are classified into cold chamber and hot chamber. The cold chamber die-casting process uses a superheated molten metal alloy. Referring to FIG. 14 we can see a cold chamber die casting machine. Molten alloy (magnesium, aluminum or zinc) is injected into a closed metal die under high pressure by way of a high-speed ram. The alloy is driven through the feed system of the die, while air from the mold escapes through vents. There must be enough metal to overflow the cavity, such that a complete part will be cast. Once full, the injection pressure on the mold is increased during solidification. The pressure is increased during solidification to reduce porosity due to shrinkage. To complete this path from the molten pot to the die cavity without starting to solidify, the melt must be superheated up to 100° C. above liquidus temperature. As the metal dies (or molds, as they are known in the plastics industry) are cooled, molten metal gets solidified into a predetermined shape. Once sufficiently cooled, the part is removed from the die.

The second well known process for casting light metal alloys is the hot chamber die casting method. Referring to FIG. 15, we can see a hot chamber die casting machine. The pressure chamber (cylinder) and the plunger are submerged in the molten metal in the pot (crucible). Hot chamber die casting means, compared to cold chamber, that the molten metal is transported directly into the die via a heated channel called a "gooseneck", thus minimizing heat loss.

As one can appreciate, both of the above-mentioned processes use melt that is heated to higher than optimal casting temperatures to compensate for heat losses. Hot chamber die-casting does not require the melt to be as hot as in cold chamber. To reduce heat losses of the melt, a significant portion of the injection system is submerged in molten metal at all times. The benefit of hot chamber die-casting is that melt travels a short distance and the cycle time is reduced. However, high temperature and continued exposure to aggressive melt creates severe material deterioration problems. As is well known, both processes suffer poor reliability due to lack of suitable materials for melt containment and no means to overcome melt corrosion and high pressure and high applicable temperature. Both processes suffer from material shrinkage in the cast parts, from 5-15%. High injection rates also cause gases to be mixed into the melt and becoming trapped in the part. Porosity is the biggest problem for a part's structural integrity. Molded metallic parts with high porosity are not desirable because of their reduced mechanical strength. It is because of this that it is very difficult to accurately dimension conventionally die cast parts, and it is even more difficult to maintain the dimensions throughout life cycle of the part. Therefore, the quality of the components made on these machines is generally poor and often does not meet the stricter requirements for the automobile industry. Because the scrap rates are high, die casters continue to use melt pots, as this allows the immediate remelting of the scrap parts. Unfortunately, producing scrap still requires energy to remelt the part, and cover gases, such as sulfur hexafluoride ($SF_6$) and carbon dioxide ($CO_2$) are wasted. Both gases have a significant environmental impact.

Besides environmental pollution, cast parts made from super heated melt are often plagued by entrapped porosities and inclusions created by large amounts of shrinkage due to rapid material cooling from superheated melt to solid near net shape parts.

FIG. 16 shows an injection molding apparatus adopted from thermoplastic processing. This apparatus has a composite cylinder with an inner diameter of 50 to 200 mm and a length of approximately 2 to 5 m. A specially devised drive is coupled to a retractable helical screw designed to transport the alloy material along the cylinder. The heat to melt the metal alloy is provided by a series of heated zones arranged along the cylinder. The forward end of the cylinder is closed by the cylinder cover but allows material transfer into a nozzle portion at the distal end of the cylinder. A specially designed check valve is placed at the forward end of the screw to facilitate injection of the molten slurry into the mold. In the art of plastic injection molding the cylinder is called a barrel and whole assembly is well known as an extruder. The cylinder can be a monolithic tube or made from Inconel 718 with specially fitted Stellite liner to reduce corrosion. Stellite is a Cobalt alloy with specific corrosion and abrasion properties suitable to contain and convey molten magnesium.

In this process, solid chips of alloy material are supplied to the injection molding apparatus through a feeder portion often called a hopper. The size of the chips is approximately 2-3 mm in diameter and generally is no longer than 10-12 mm. The chips are produced from standard die casting alloys in ingot form. The ingots are chipped to size by a separate machine designed for this purpose. The comminuted chips are fed into a hopper and further processed in the injection molding extruder into a supposedly preferential state called a slurry-like melt, which is, in its best form, in a partially molten state. The injection screw shears the melt and pushes the melt forward over a check valve on the distal end of the extruder and is subsequently injected into a closed and clamped injection mold. The machine nozzle dispenses the thixotropic slurry into a mold portion of the SSIM apparatus, often called a sprue. The sprue is a part of the mold assembly not described in this enclosure.

There is a clear advantage of the slurry (Thixomolding®) process over the die casting process in the fact that process does not use $SF_6$ cover gas. Small amounts of argon gas are used to protect the melt from oxidation. Argon is heavier than air and tends to stay close to earth and gets dissolved and returned to air naturally. However, one familiar with this state of the art will appreciate that the Thixomolding® and similar semi-solid processes are complex and require a very long melt passageway. All of these methods and processes are carried out within a single cylindrical housing. Manufacturing suitable barrels is a tedious and requires expensive alloys and processes. As a result only a few suppliers are able to produce composite barrels with Stellite liners in Inconel housings with the dimensional requirements for large throughput for any serious part molding using these methods.

Very accurate control of the process temperature is essential for successful and repeatable molding of good parts with injection molding methods disclosed above. It is very difficult to control all of the process parameters within a single cylindrical housing, particularly temperature, shot volume, pressure, cycle time, etc., and as a result, inconsistent characteristics of the molded metallic parts are produced. As a consequence, if a molded metallic part of undesired characteristics is produced by a semi solid slurry molding machine, recycling of the defective part is not possible. Metal parts molded by injection molding machines with high solid contents may have an uneven surface. Such metal parts may require further processing before they can be painted. Finally, the above mentioned injection molding process is complex and expensive to manufacture, and is plagued by the reliability of its machine parts. Further, it lacks the wide operating window and stability that are required for a viable manufacturing process.

One skilled in the art can recognize the complexities involved in the die casting process and structures (cold and hot chamber) as well as in the molding process and structures (Rheomolding and Thixomolding®). Both processing routes are largely unreliable and suffer from a lack of consistency from shot to shot and part to part. There is a need for a new and simpler structure with a stable processing window and without the use of $SF_6$ cover gas. Furthermore, molds for above machines are mostly cooled by oil. Oil is environmentally unfriendly and there is a need to eliminate the oil for any kind of cooling on the machine.

SUMMARY OF THE INVENTION

It is an object of the present invention to provide a casting machine having a simple design which is economic and practical to reproduce and yet overcomes the disadvantages of the prior art while enabling the casting of parts having very few defects. A casting machine made in accordance with one aspect of the present invention includes a processing cylinder formed in a thermally conductive block, said processing cylinder having a processing chamber and opposite first and second ends, the first end of the processing cylinder being configured to receive the metal feedstock. The machine further includes an injector cylinder formed in the thermally conductive block adjacent the processing cylinder, the injector cylinder having a shooting pot coupled to the second end of the processing cylinder by a passage configured to permit feedstock to pass from the processing cylinder into the shooting pot, a nozzle coupled to the injector cylinder configured to couple to the mold. The device includes a processing drive for driving the feedstock from the first end of the processing cylinder through the passage into the shooting pot and a heater thermally coupled to the processing cylinder. The heater and processing cylinder are configured to heat the feedstock such that the feedstock becomes progressively more liquid as it passes from the first to the second end of the processing cylinder. The machine further includes an injector plunger coupled to an injector actuator for driving the plunger sufficiently to force the metal from the shooting pot through the nozzle and into the mold.

A casting machine made in accordance with another aspect of the present invention includes a thermally conductive block having a processing cylinder and an adjacent injector cylinder formed therein. The processing cylinder has opposite first and second ends, the first end configured to receive casting feedstock. The block is thermally coupled to a heater. The heater, block and processing cylinder are configured to heat the feedstock such that the feedstock becomes progressively more liquid as it passes from the first to the second end of the processing cylinder. The injector cylinder has a shooting pot and an injector plunger coupled to a nozzle, the shooting pot being coupled to the second end of the feedstock processing cylinder by a passage. The passage is configured to permit the one way movement of heated feedstock from the processing cylinder into the shooting pot. The injector plunger is configured to inject the heated feedstock through the nozzle and into the mold.

A casting machine made in accordance with another aspect of the present invention includes a mold having a plurality of mold portions, each mold portion configured to mold a different portion of the part. The casting machine further includes a plurality of molding units, each molding unit being coupled to one of said portions for molding said portion. Each molding unit includes a thermally conductive block with a processing cylinder formed therein, said processing cylinder having opposite first and second ends, the first end configured to receive the feedstock. The block is thermally coupled to a heater, which together with the block and the processing cylinder are configured to heat the feedstock such that the feedstock becomes progressively more liquid as it passes from the first to the second end of the processing cylinder. The molding unites further include an injector cylinder formed in the block adjacent the processing cylinder, the injector cylinder having a shooting pot, an injector plunger and a nozzle, the nozzle being coupled to the mold portion. The shooting pot is coupled to the second end of the feed stock processing cylinder by a passage configured to permit the movement of heated feedstock from the processing cylinder into the shooting pot. The injector plunger is configured to inject the heated feedstock through the nozzle and into the mold.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

FIG. 10 is a perspective view of an alternate embodiment of the present invention.

FIG. 11 is a perspective view of an alternate embodiment of the present invention.

FIG. 13 shows a mold heating and cooling plate.

FIGS. 14 to 16 show prior art casting machines.

In the drawings like characters of reference indicate corresponding parts in the different figures.

DETAILED DESCRIPTION OF THE INVENTION

In the description of the preferred embodiment which follows, the cast part is preferably produced from magnesium alloy, preferably AZ91 D, in a novel machine that will be illustrated and described below. This apparatus and method of casting high integrity parts is not limited to magnesium alloys and is equally applicable to any other type of metal, such as aluminum (A1), zinc alloys and any other alloy suitable for semisolid or liquidus processing. A high integrity part is understood to be one with minimal or no porosity or inclusions and metallurgical composition with a preferred dendrites free structure. Furthermore, specific temperature ranges used in the description will be relevant for magnesium alloy, but do not preclude the use of other alloys. The maximum operating temperature for this invention is preferably 700° C., however the actual operating temperature is limited only by the current availability of special materials capable of withstanding the harsh conditions imposed by liquid alloys. Other raw material that can be successfully processed according to this invention could potentially come from materials with much higher melt temperatures but when combined with at least one additional metallic alloy or at least one ceramic composition and/or structure will be processable at temperatures less than 700° C. As well, the present invention may find use in other molding applications such as thermosets, liquid metal, composites, powder metal molding and/or other process where processing temperature does not exceed 700° C.

The above-mentioned raw materials can be used in various forms and physical shapes where the only limitation is that they are in a preferential form that maximizes outside surface of the forms for maximum heat uptake. Heat energy is absorbed by conduction, and the amount of heat is proportional to the surface temperature of the bulk material. The preferential form of the material would be one that absorbs a large quantity of heat as quickly as possible at a uniform rate through the total bulk of the material. Reducing the size of the particles of the feedstock can artificially increase the surface area. Preferred particle shapes are formed of prolate spheroid (football like shapes) where polar diameter is 6-16 mm and equatorial diameter is 2-4 mm. This form and shape or its approximations have relatively large surface area and absorbs heat optimally, yet it flows easily through passages or melt channels and does not clog them. While powder materials have the extreme values of available surface, this feedstock is not recommended due to spontaneous combustion hazards and the notorious tendency to conglomerate, as well as the inability to heat by conduction.

Figure 1:
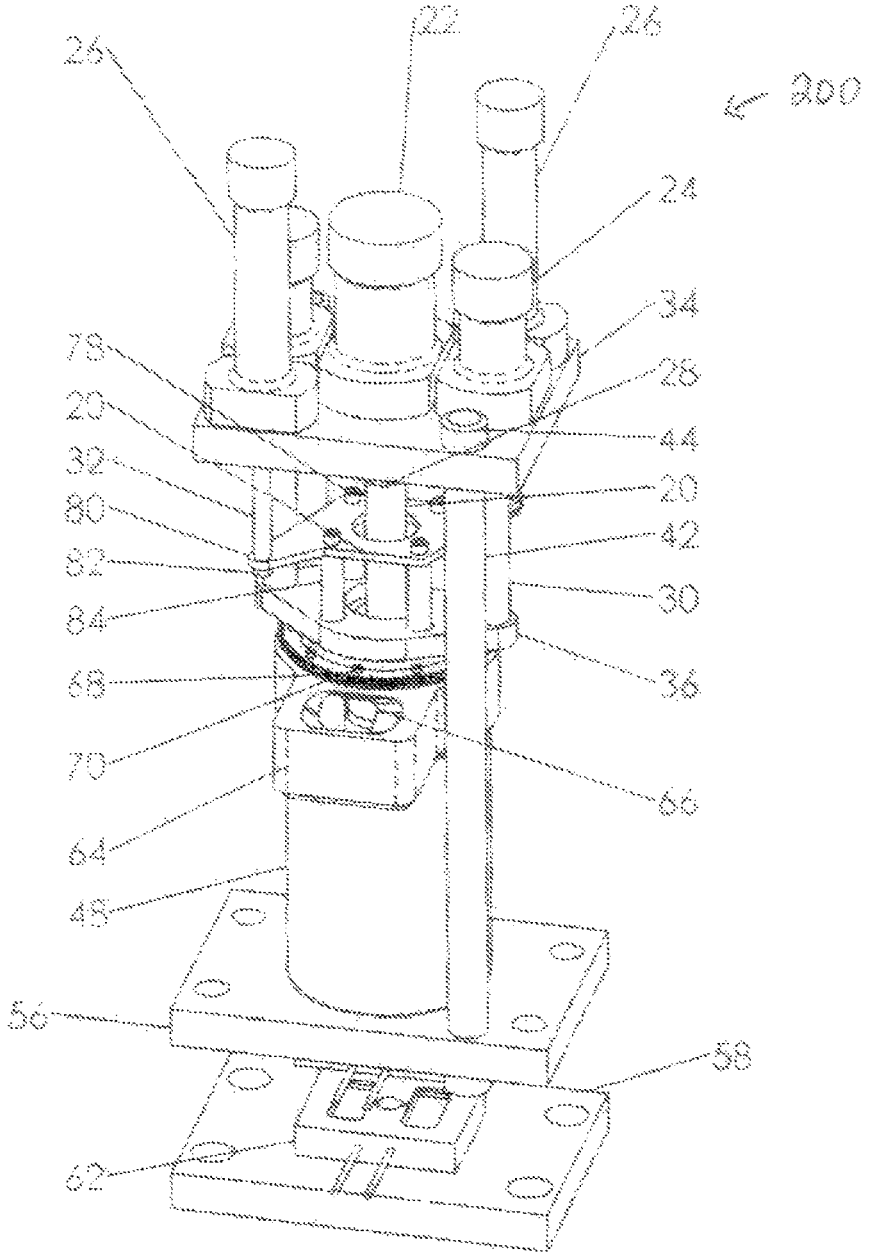
FIG. 1 is a perspective view of a casting machine made in accordance with the present invention and showing the injector assembly.
Figure 2:
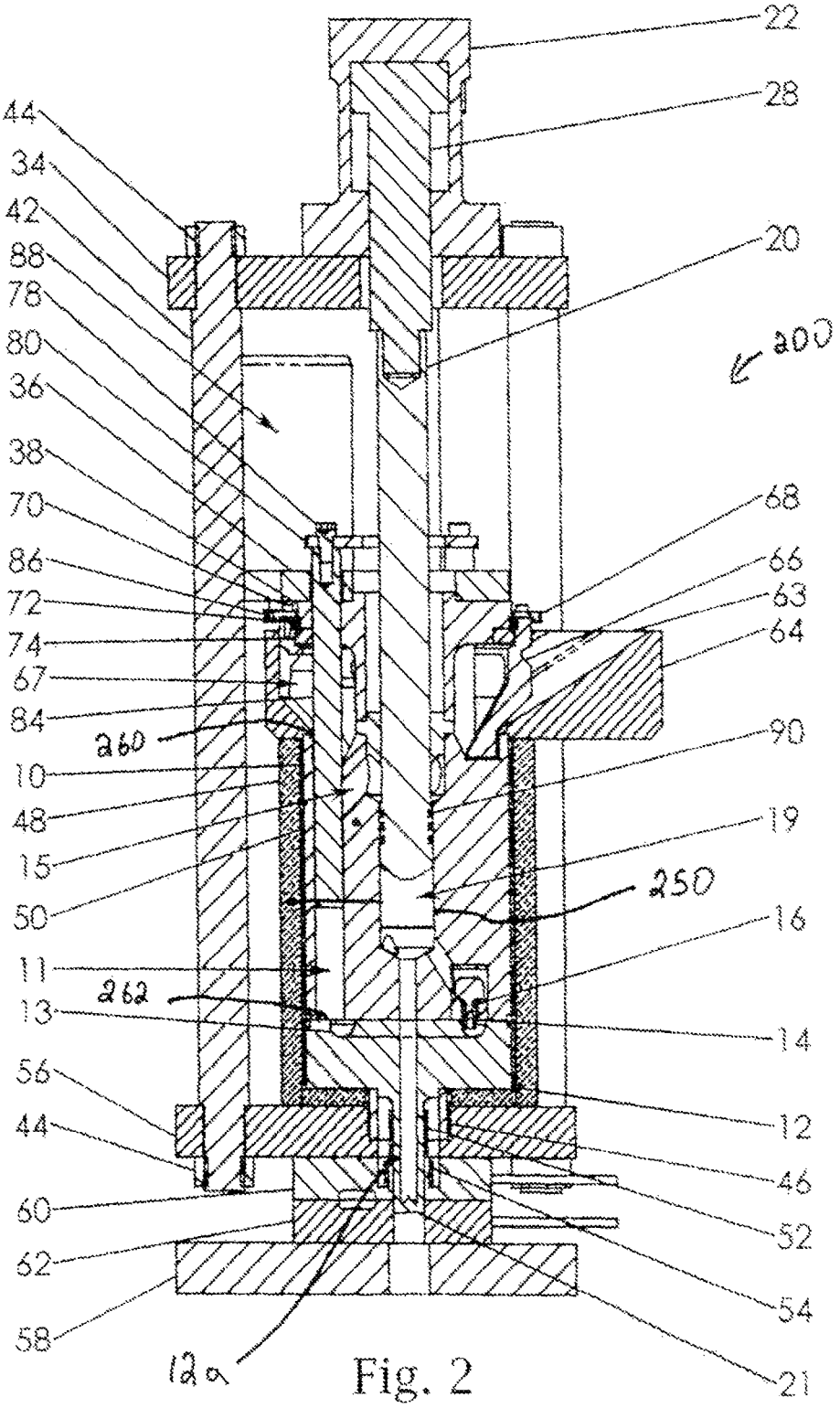
FIG. 2 is an aligned section view of the injector assembly shown in FIG. 1 through the tie rods and feed port and showing the connecting galleries for flow of the material being processed.

Referring firstly to FIG. 2, the present invention is a casting machine unit for metal alloys and is shown generally as item 200, which has a thermally conductive block 10 (also called a processing barrel) having a plurality of processing cylinders 11 formed therein adjacent to and surrounding a centrally positioned injection cylinder 250 which is also formed in the block (processing barrel) 10. Each of the processing cylinders 11 have opposite first ends 260 and second ends 262. First end 260 is configured to receive the feedstock (not shown). Second end 262 is coupled to shooting pot 19 of injector cylinder 250 by passage 13. Processing plungers (also called stuffer rods) 84 are provided to drive the feedstock from first end 260 towards second end 262. Heater 50 is coupled to block (barrel) 10 and provides sufficient heat to progressively melt the feedstock as it passes from ends 260 to 262 such that the feedstock becomes progressively more liquid as it passes to end 262. Preferably, heater 50 and cylinders 11 are shaped such that the feedstock is not completely melted (i.e. liquidous) when it exits end 262 and passes to shooting pot 19. Plunger (stuffer rod) 84 is coupled to a processing drive 26 (see FIG. 1) which is configured to urge the feedstock sufficiently such that it passes into shooting pot 19. The feedstock may, under the right circumstances, be driven simply by the force of gravity; however, the processing drive preferably consists of an actuator of some type such as a pneumatic or hydraulic piston. Processing plunger 20 is likewise coupled to an injector actuator or drive 22 which is configured to force the feedstock in shooting pot 19 through nozzle 12*a* and into the mold (not shown).

Referring now to FIG. 1, this figure shows the general external configuration of the device. Tie rods 42 and nuts 44 connect the upper platen 56 to an upper plate 34 which is connected to cylinders 22, 24 and 26. Cylinder 22 contains piston 28 which is connected to plunger 20. This arrangement provides vertical movement of the plunger 20.

Cylinders 26 contain pistons 32 which are connected to a first member (also called stuffer plate) 80 by nuts 82. The stuffer plate 80 is connected to the processing cylinder plungers (also called stuffer rods) 84 with screws 78. This arrangement provides vertical movement of the stuffer rods 84. Cylinders 24 contain pistons 30 which are connected to the top plate (or cap) 36. This arrangement provides a clamping force which keeps the stack of hot components loaded vertically in compression during the operation of the machine and eliminates the requirement for high-temperature fasteners. Lower platen 58 holds the lower half of the mold 62 and can move downwards to open the mold and allow removal of the cast part. Feed housing 64 has an opening into which the feedstock is supplied. Insulated blanket 48 prevents excessive heat loss from the hot internal components to the rest of the machine or the environment.

Referring now to FIG. 2, the vertically oriented processing barrel 10 receives solid metal feedstock from a port 63 in a feed housing 64, melts the metal feedstock and injects it using a plunger 20 into a mold 60 and 62 to create a solid metal part. Starting with the feedstock entering the port 63 in the feed housing 64, the feedstock is distributed across the upper surface of the processing barrel 10 using a rotating distributor 66. The feedstock enters one or more vertical holes or cavities 11 in the processing barrel 10. Motor 88 drives a pinion 86 which meshes with and drives gear 68. Gear 68 is attached to the rotating distributor 66 using screws 70. Distributor 66 can be stopped in a position where slots 67 in the distributor 66 align with the holes 11 in the processing barrel 10.

One or more stuffer rods 84 reciprocate vertically through the slots 67 in the distributor 66 and inside the holes 11 in the processing barrel 10 to push the feedstock downward into the processing barrel 10. When in the uppermost position, the stuffer rods 84 are clear of the distributor 66 such that the distributor 66 can rotate.

The processing barrel 10 is heated by heaters 50. Excessive heat loss to the environment and adjacent machine components is prevented by an insulating blanket 48. The feedstock is pushed by the stuffer rods 84 such that it makes contact with the walls of the holes 11 in the processing barrel 10 and is melted either partially or fully. The resulting slurry is pushed by the stuffer rods 84 through a groove or cavity 13 in the upper surface of the cap 12 which opens a check valve 16 off its seat 14 allowing the slurry to enter the shooting pot 19 beneath the plunger 20. The plunger 20 has sealing rings 90 which prevent most of the material from flowing upwards past the rings 90. Any material which does leak past the sealing rings 90 is returned to the external holes 11 in the processing barrel 10 through angled drillings 15. The plunger 20 is forced downwards at high speed by the piston 28 which moves inside cylinder 22. The pressure of the slurry and gravity close the check valve 16 against seat 14 which prevents the pressurized slurry from returning into the stuffer bores 11 through cavity 13. The pressurized slurry is forced from the shooting pot 19 of the processing barrel 10 through the cap 12 and the nozzle 21 into the mold 60 and 62 which is held between an upper platen 56 and a lower platen 58. The mold removes heat from the slurry such that a solid part is cast. A heater 50 maintains the temperature of the nozzle 21 so that the slurry does not solidify inside it. Another heater 52 maintains the temperature of the nozzle 21 when it is engaged with the mold 60 such that the slurry does not solidify inside the nozzle 21. Tie rods 42 and nuts 44 couple the upper platen 56 to the upper plate 34 which provides a suitably rigid base for the cylinders 22.

Figure 3:
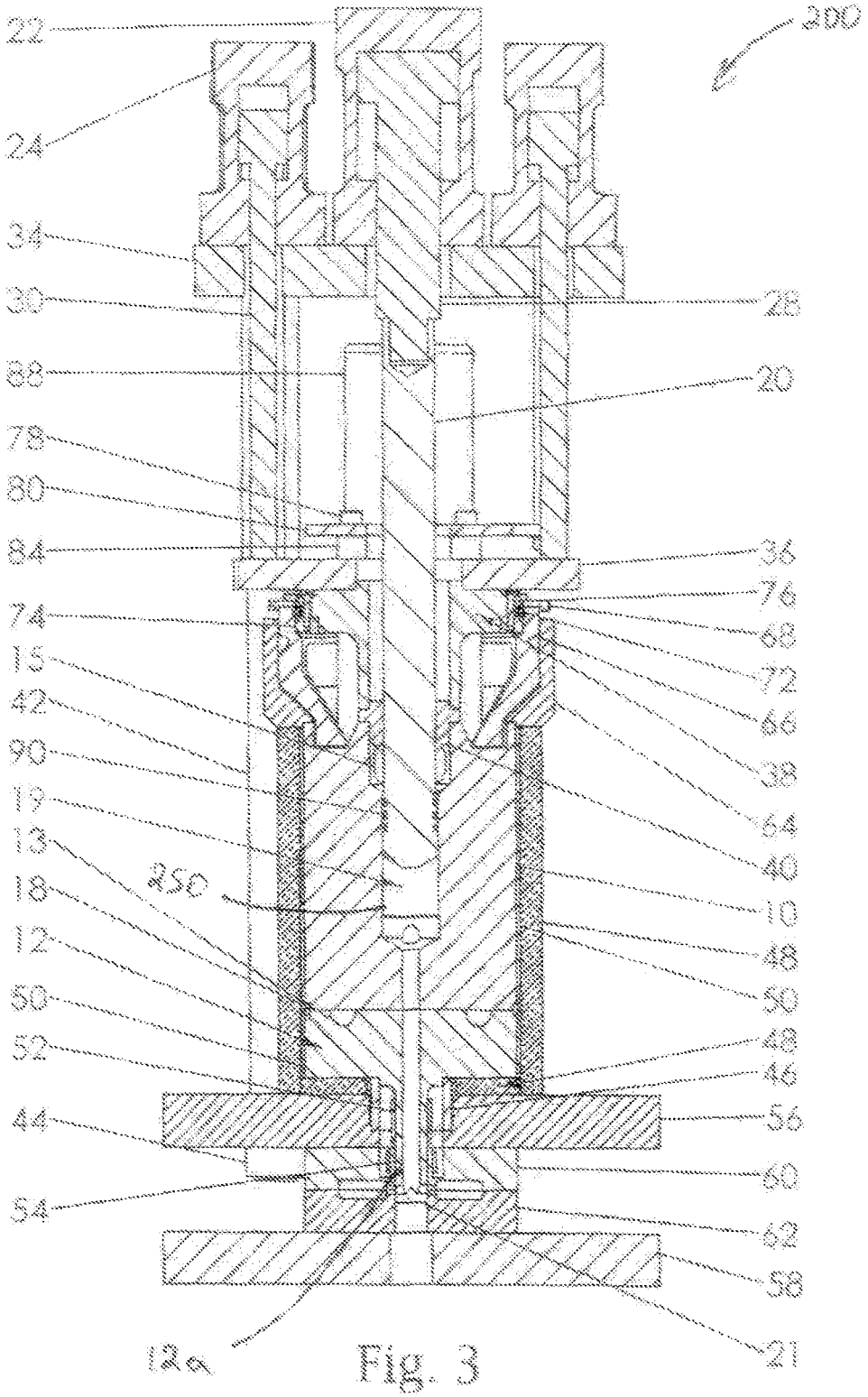
FIG. 3 is an alternative section view of the injector assembly of FIG. 1 showing the load path through the structure.

Referring now to FIG. 3, tie rods 42 and nuts 44 couple the upper platen 56 to the upper plate 34 which provides a suitably rigid base for the cylinders 22 and 24. Pistons 30 push down on top plate 36. Top plate 36 pushes on the upper ring 38 which is designed to minimize heat flow from the hot components underneath to the cooler top plate 36. The outer edge of the upper ring 38 has a retainer 74 which holds a bearing 72 which supports the distributor 66 and allows it to rotate. Screws 76 clamp the bearing 72 between the upper ring 38 and the retainer 74. A scraper ring 40 is clamped between the upper surface of the processing barrel 10 and the upper ring 38. The scraper ring 40 removes any material which may have leaked past the sealing rings 90 and has become stuck to the plunger 20. This material is returned to the external holes in the processing barrel 10 through angled drillings 15. A sealing ring 18 prevents slurry from escaping to the outside through the joint between the cap 12 and the processing barrel 10. Leakage from the high pressure zone in the center bore of the processing barrel through the joint between the processing barrel 10 and the cap 12 is minimized by the high clamping forces provided by the clamping cylinders 24 and pistons 30. Any leakage from this joint simply mixes with the low-pressure slurry in the adjacent gallery in the cap 12.

Figure 4:
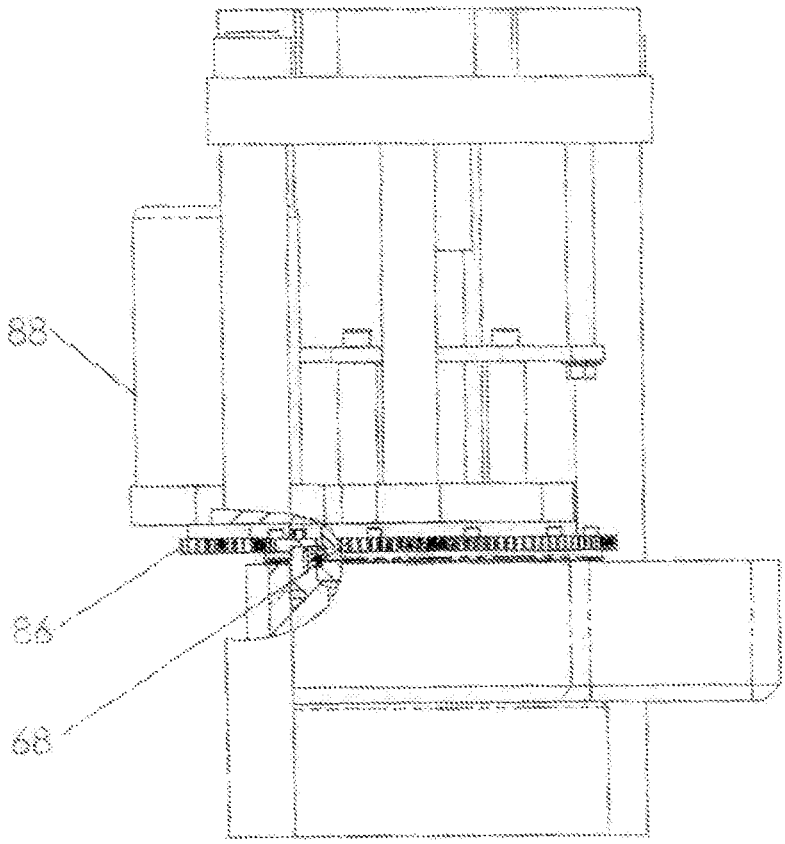
FIG. 4 is a view showing the drive mechanism for the distributor.
Figure 17:
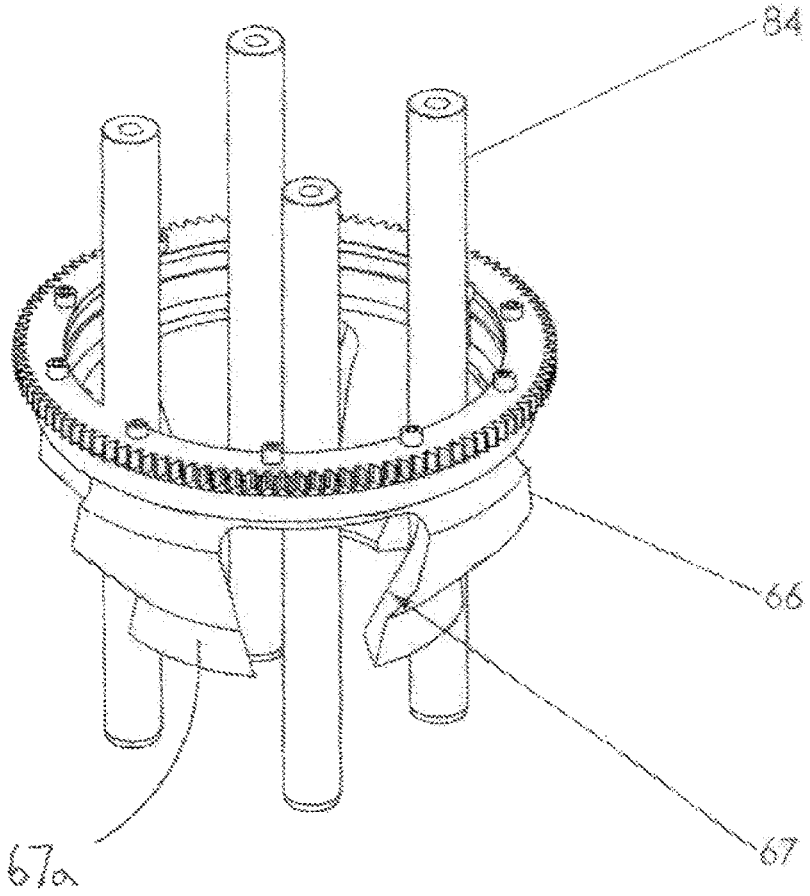
FIG. 17 is a perspective view of a portion of the casting machine shown in FIG. 1 and showing the interaction of the distributor vanes with the processing plungers.

FIG. 4 shows a little more clearly the motor 88 which drives a pinion 86 which meshes with and drives gear 68. FIG. 17 shows how stuffer rods 84 pass through openings 67 in distributor member 66 and between projecting fingers 67*a*.

Figure 5:
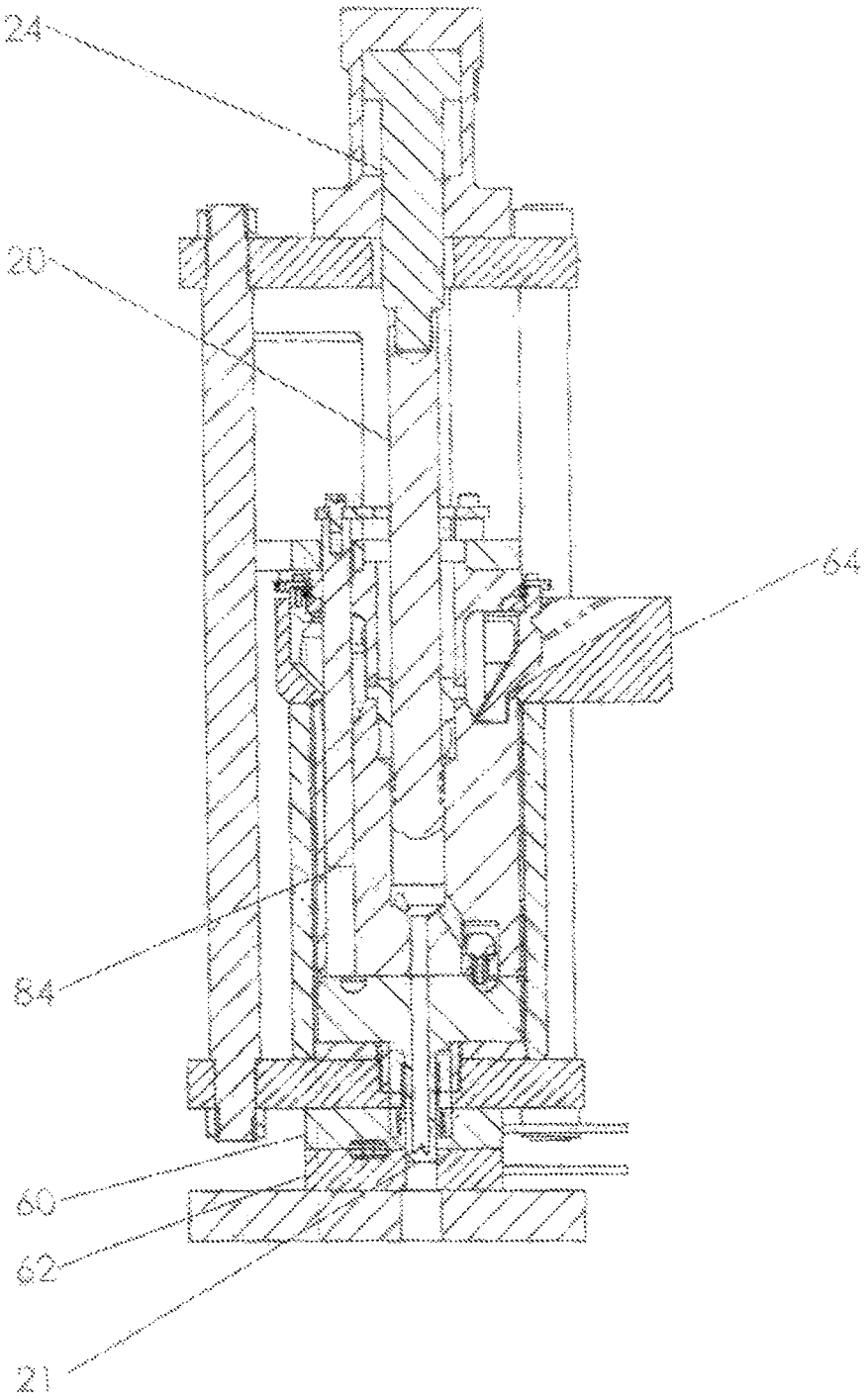
FIGS. 5 through 9 are a series of sectional views of the casting machine shown in FIG. 1 and showing the sequence of operation of the internal components of the injector.

FIGS. 5 through 9 show the sequence of operation of the devices. In FIG. 5, the components are positioned such that the slurry is ready to be injected into the mold 60 and 62 by the plunger 20. Nozzle ports (ports in the lower end of cap 12) are aligned with channels in the mold 60 and 62 to accept the slurry. At this point the slurry inside the nozzle ports (lower thin part of cap 12) is in a semi-solid state which prevents premature flow into the mold.

Figure 6:
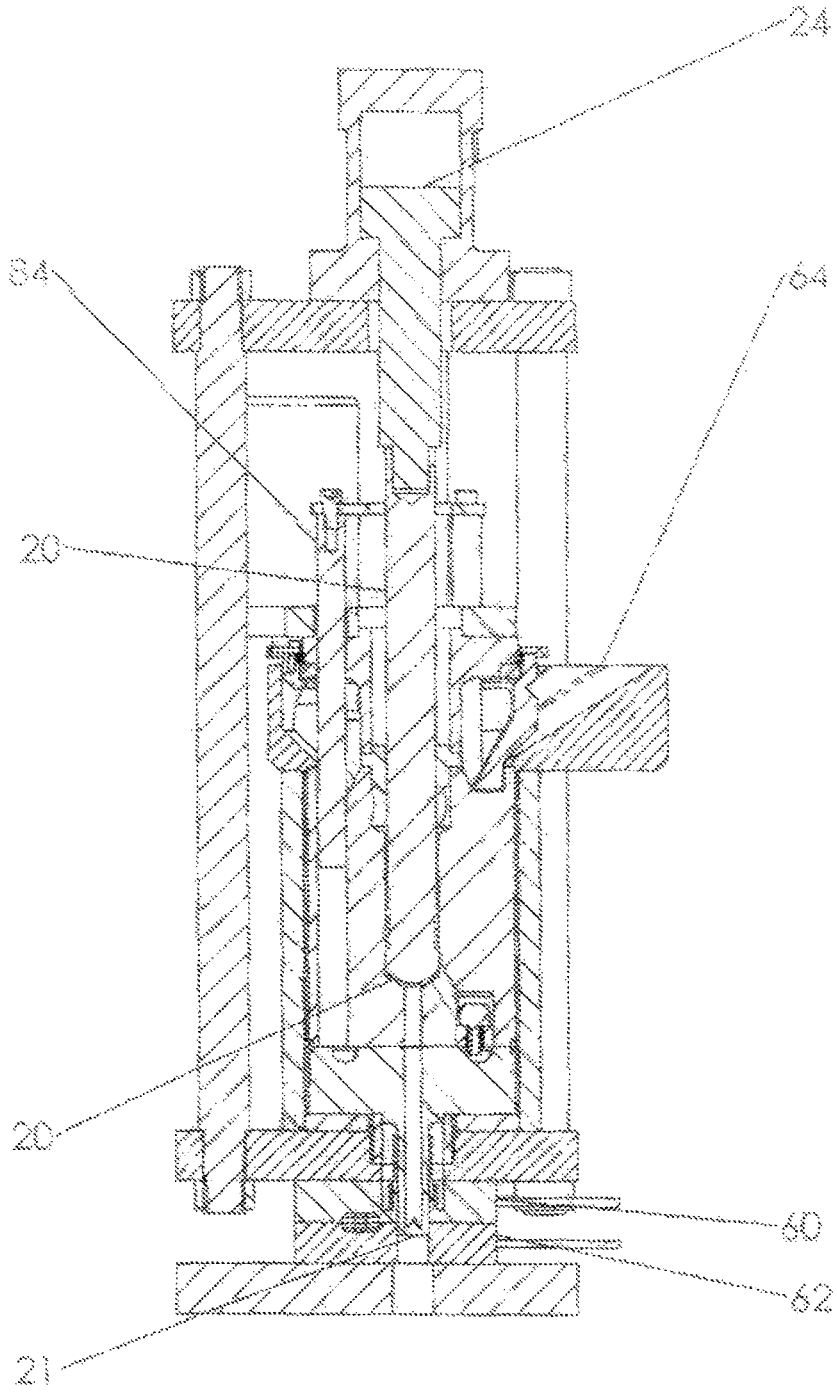

In FIG. 6, piston 24 pushes plunger 20 downwards to inject the slurry into the mold 60 and 62. The pressure of the slurry overcomes the resistance to flow through the nozzle ports (ports in the cap 12). During or following the inject cycle, stuffer rods 84 may start to move upwards in preparation for receiving more solid feedstock through the feed housing 64. Once the part has been cast, it freezes off forming plugs of solidified material in the nozzle ports.

Figure 7:
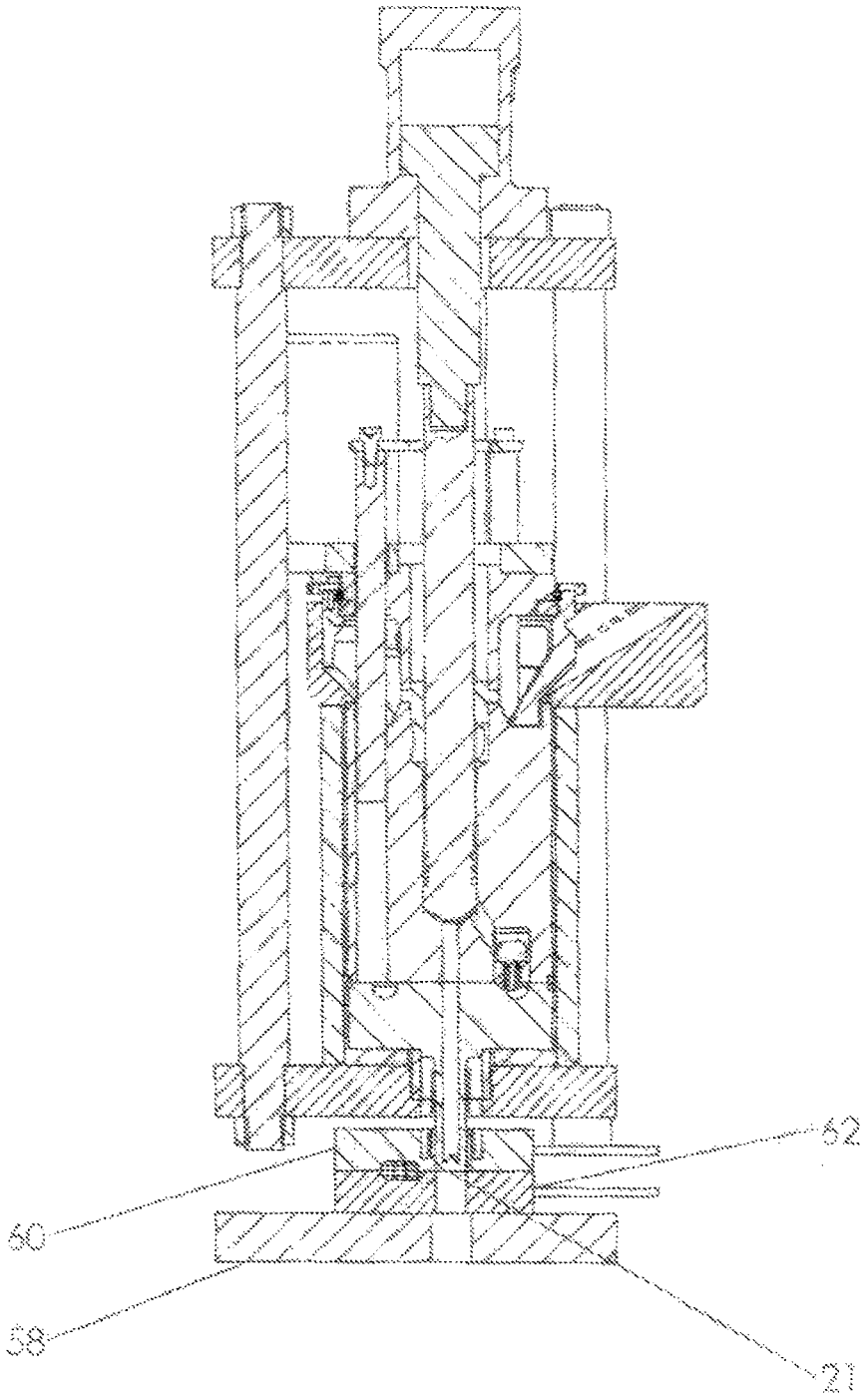

In FIG. 7, the upper mold half 60, lower mold half 62 and lower platen 58 move downward by the mold actuator (not shown) to a position where the nozzle ports are blocked by the mold upper half 60. This shears off the plugs in the nozzle and prevents leakage through those ports.

Figure 8:
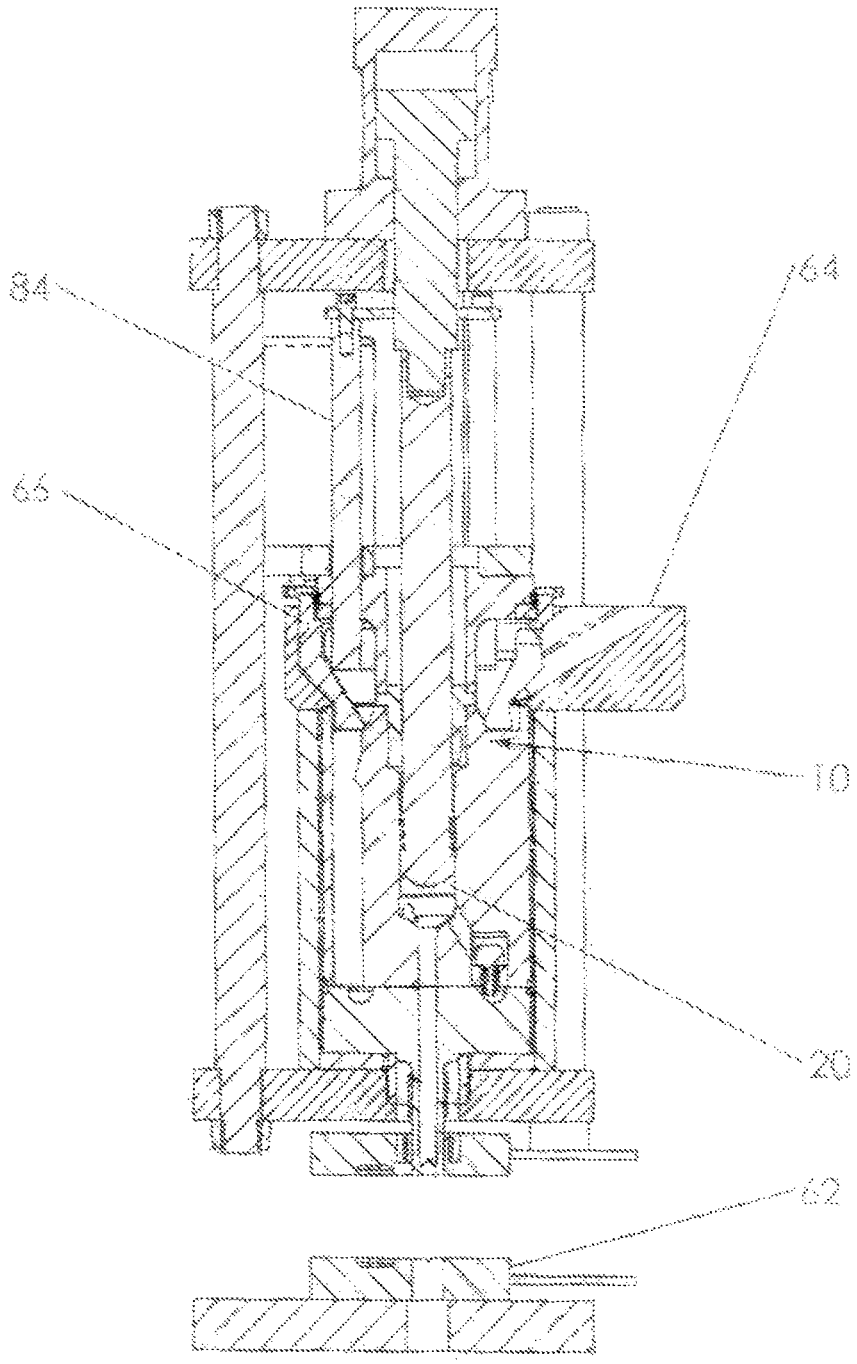

In FIG. 8, the stuffer rods 84 are in the uppermost position which allows distributor ring 66 to rotate, distributing feedstock from the feed housing 64 into the top chamber of the processing barrel 10, the mold lower half 62, concurrently opens fully to allow the cast part to be extracted.

Figure 9:
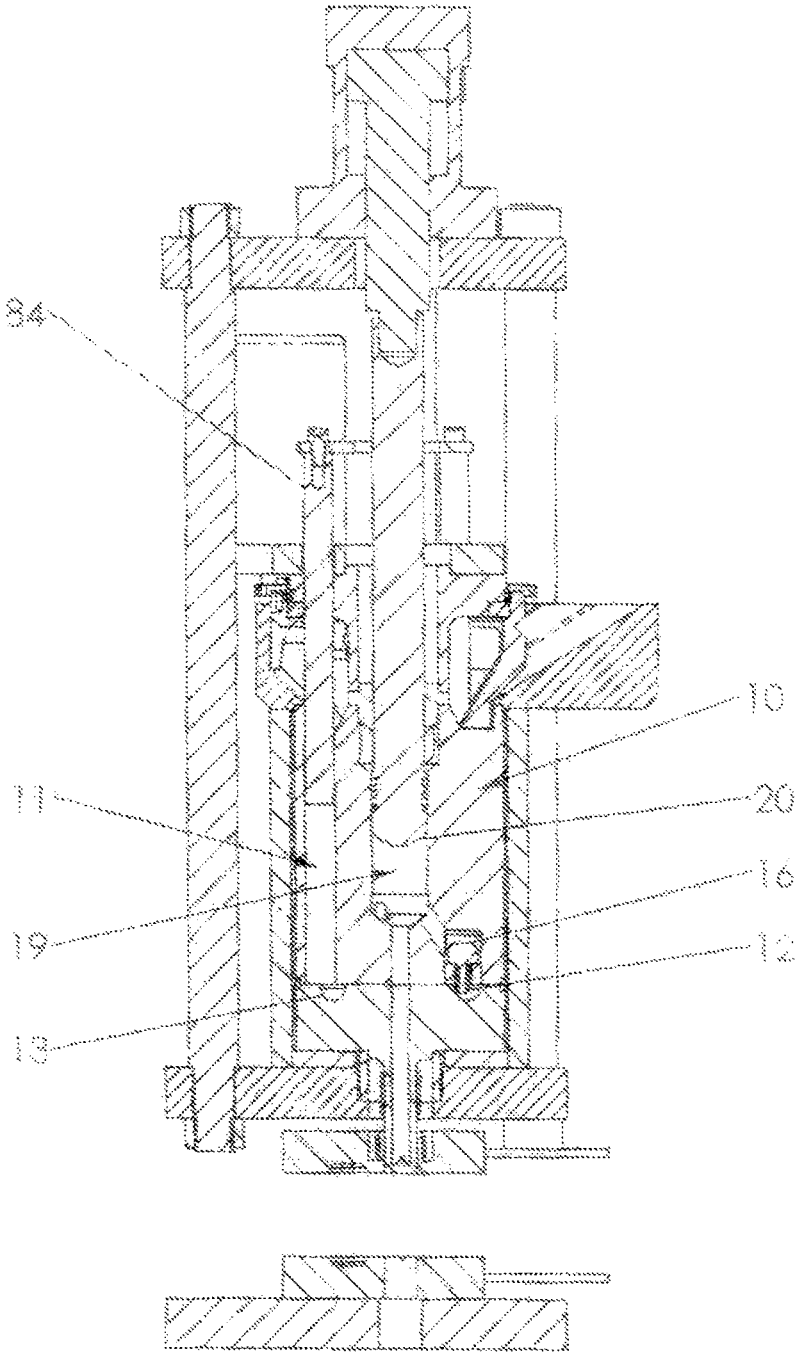

In FIG. 9, the stuffer rods 84 are moving downward to push feedstock into the external cavities in processing barrel 10. Feedstock which has already melted fully or partially is forced through a channel in the accumulation chamber (the upper surface of cap 12) through check valve 16 into the shooting pot (the cavity below the plunger 20), forcing the plunger to move upwards. Once the stuffer rods 84 stop their downward movement, check valve 16 closes by gravity, preventing back-flow. This cycle can be repeated two or more times during each molding cycle to accumulate sufficient slurry to force the next cast part.

Referring to FIGS. 10 and 11, in addition to the preferred embodiment discussed above, other possible embodiments of this invention are possible which incorporate a thermally conductive processing barrel and stuffer cavities. In FIG. 10 illustrates one such embodiment 100 which consists of a concentric structure of a processing barrel 110. In the centre is plunger cavity 112 with shooting pot 114. The processing chamber (or cylinder) 116 is around the injector barrel 110 and coupled to the shooting pot by passage 115. The heaters (not shown) are mounted on the outside wall of the processing cylinder.

In FIG. 11, an alternate embodiment 120 is illustrated which includes the injector cylinder 111 with plunger and shooting pot is in the centre. The heaters (not shown) are mounted on the outside wall of the injector barrel. External stuffer (processing) cylinders 122 are positioned around the injector barrel and each of them is heated separately. On the bottom of the external stuffer cavity slurry a transfer valve can be mounted. Usually the bottom is directly connected to the accumulation chamber.

Figure 12:
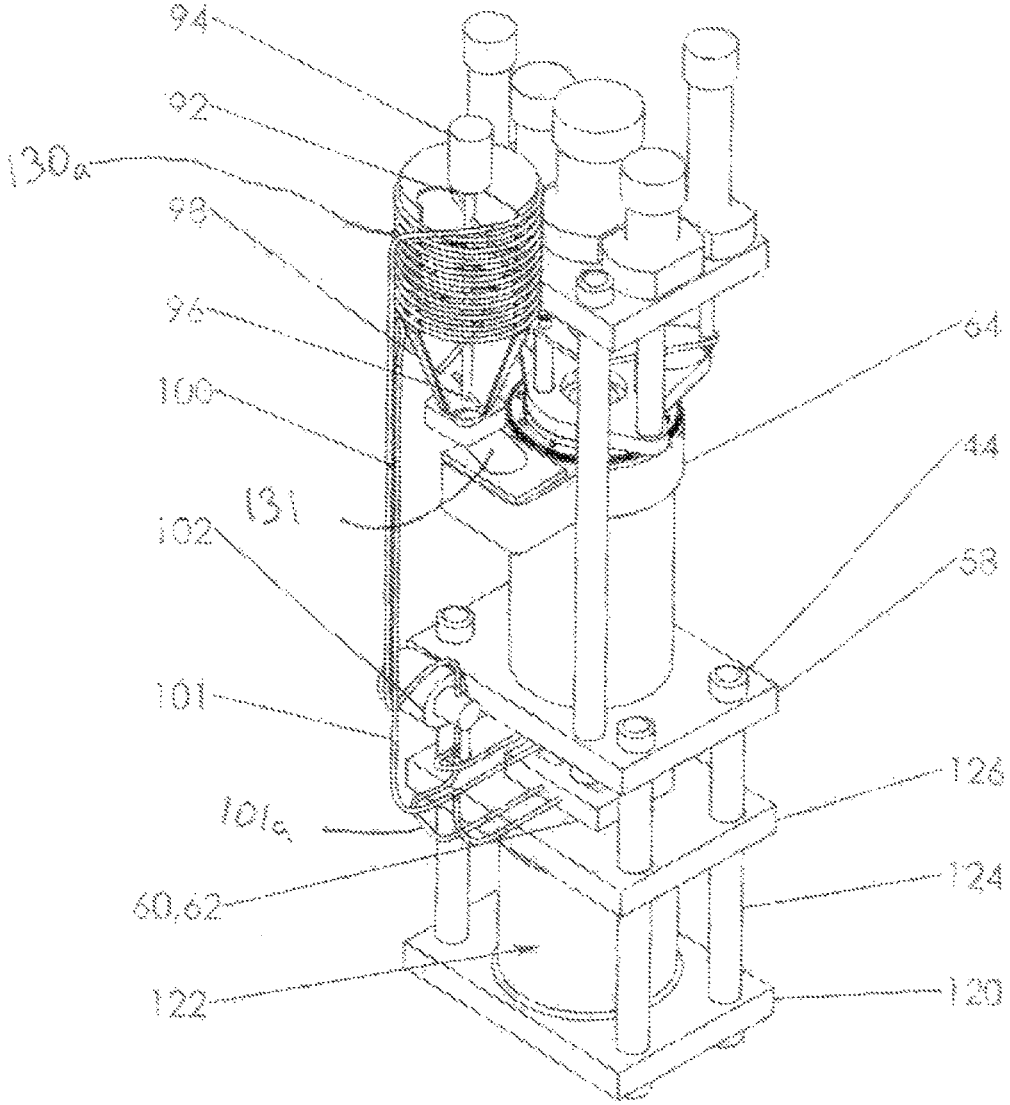
FIG. 12 is a perspective view of the casting machine shown in FIG. 1 coupled to a feedstock pre-conditioning system.

Referring now to FIG. 12, the feedstock conditioner 130*a* is used to eliminate moisture and oxygen molecules attached to the particles of feedstock material. Preferred feedstock material is prolate spheroid (football like shape) but similar elongated cylinders or cigar shaped forms are also useable. For practicality reasons these ideally suited shapes are an approximation of the elongated chopped spaghetti chips. Solid ingots could further be cut or machined or chopped into suitably designed forms that closely resemble preferred shapes.

This invention is not limited by the type of feedstock used. This invention only requires comminuted material due to the need for short residence time processing to preserve the preferred metallurgical characteristics of the feedstock. The preferred embodiment of this invention is to preserve all inherited feedstock properties and not change them. The preferred embodiment of the feedstock conditioner 130*a* heats the feedstock to a maximum temperature of 425° C. for magnesium. The heat energy used by conditioner 130*a* comes from cooling mold 60 via a mold cooler 62. Mold cooler 62 is coupled to conditioner 130*a* by pipes 101*a*, pump 102, pipe 100 and return pipe 101. A suitable heat transfer medium (or coolant) flows through the cooler, pipes and pump. Heat removed from the cast part is conductively brought into the feedstock conditioner, and under an atmosphere of hot argon, proper purging of the feedstock material is accomplished. So, high energy efficiency is achieved by this invention when energy added to melt during viscosity modulation is then recovered and used for material preheating, therefore returned back into the process and not rejected into the atmosphere as is done in earlier disclosures cited here for reference. Use of the heated argon in the preferred embodiment facilitates a bubbling effect of the feedstock where the feedstock behaves as a liquid for uniform heat transfer by convection and in addition to conduction. In addition to recovered energy, additional electrical energy may be added to this part of the process.

Looking further in FIG. 12, once feedstock conditioning is completed, the feedstock is advanced into a feedstock distributor via tube 131 by gravity or by way of powered auger metering (not shown).

Referring now to FIG. 13, the mold heating/cooling plates are made to remove heat from the castings. Heating/cooling plates are attached to the mold to maintain optimal mold temperature. The mold is heated to optimum temperature using an electric heater element (not shown) placed into the heater channel 5. When a part is cast, heat is imparted to the mold and the cooling plate. Atomized water (80% air and 20% water) is injected into the cooling channels 1 through nozzles 4 inserted into holes 2. As the atomized water comes in contact with the walls of the channels, the water droplets (smaller than 200 microns and preferably between 25 to 75 microns) change from liquid to gas, absorbing heat. The gaseous water is then forced to exit the cooling plate through the exhaust port 3 using compressed air from the spray nozzle. When the mold has reached the desired temperature, the spray is turned off and compressed air is used to chase any remaining steam out. The heater plate sits on the top of the cooling plate and faces the mold insert. The cooling-heating plate has one side dedicated to cooling and on the other side facing the cavity insert electrical heaters are inserted into grooves. At least one temperature feedback device is attached to the heating and/or cooling side of the plate to effectively and controllably regulate the temperature of the plate. Experimental testing and measurements discovered that large amounts of heat can be removed from the plate by mixing air with atomized water. High-pressure air is injected in the pressurized water to generate a fine mist like cooling medium suitably applied in a controllable manner to the cooling side of the plate. While water-cooling is well used for cooling molds, specially prepared water-air mixtures have not been used for cooling in part casting operations. It is not known to these inventors that any such applications are used in the die-casting industry using water air mixture for mold/die cooling. It is a surprising discovery that the air water mixture in this preferred embodiment is never sprayed into a closed cavity of the cooling plate created in a specific pattern to remove heat. The preferred pattern of the engraving into the cooling plate is diamond shape islands with rectangular channels in between. This pattern provides the best heat removal rate. The specifically developed pattern is optimized to increase surface heat removal. Almost without exception hot oil is used to cool and heat molds. Hot oil has a low flash point and in combination with magnesium explodes in fire. Additionally, oil is not a good thermal conductor of heat and is very inefficient as either a cooling or heating medium. Because of this, expensive and large heat exchangers are used to heat a large volume of oil and for removing heat from the oil, water is then used. As well, often at such high operating temperatures oil fittings leak and constant potential for environmental contamination exists.

Figure 18:
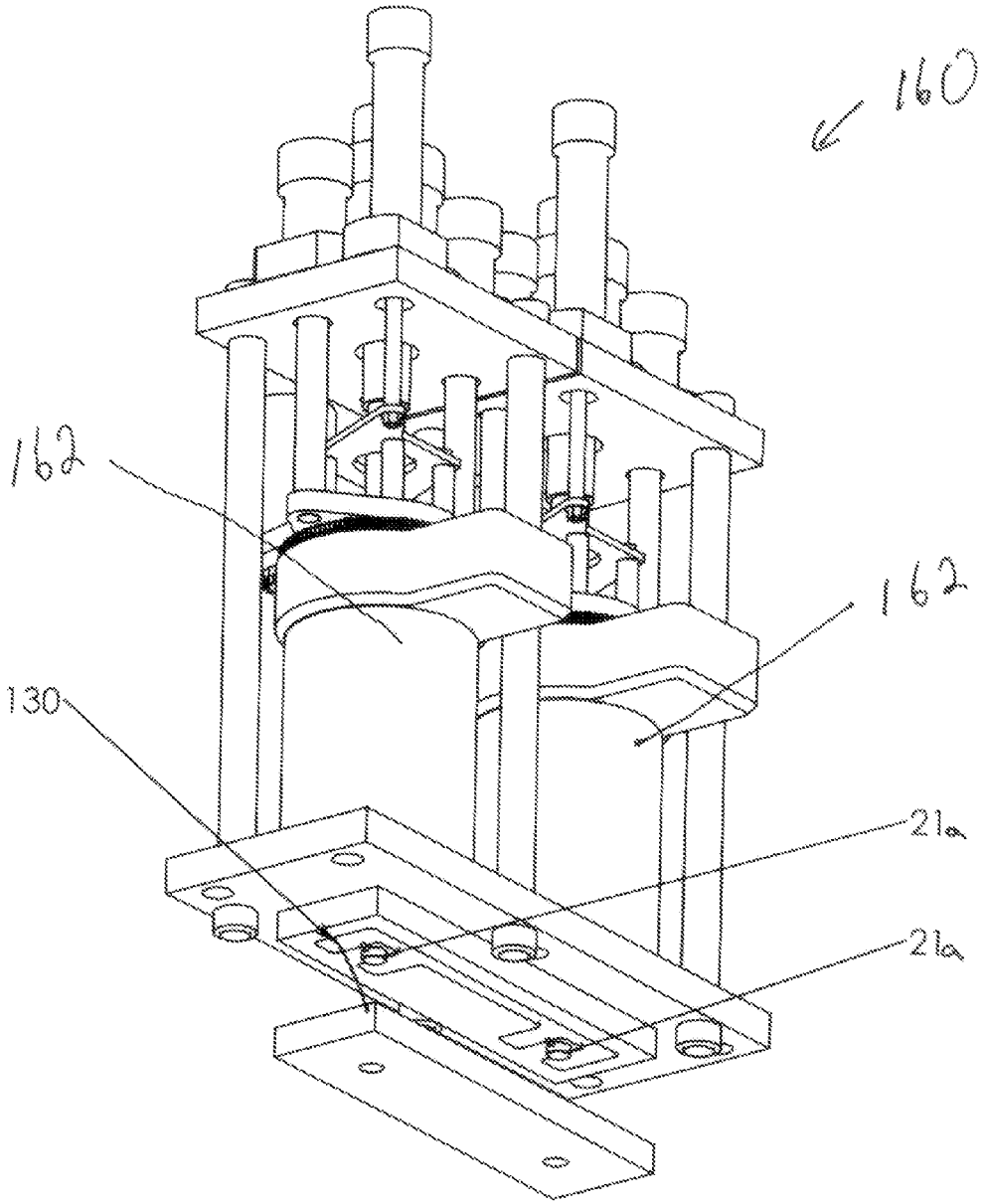
FIG. 18 is a perspective view of an alternate embodiment of the present invention showing two casting units made in accordance with the present invention combined to mold a large part.

Referring now to FIG. 18, it is possible to use the compact casting machine to mold (or cast) large parts using a plurality of smaller molding (or casting) units. A modular molding machine made in accordance with one aspect of this invention is shown generally as item 160 and consists of a plurality (in this case two) of molding units 162. Molding units 162 are each identical in every way to casting machine 200 shown in FIG. 1 and discussed above. The molding units 162 each have a molding nozzle 21 which is coupled to a different portion of mold 130. Each portion of mold 130 casts (or molds) a different portion of the finished part (not shown), therefore each molding unit 162 casts (or molds) a different portion of the part.

When the mold opens, the cast part is attached to the core portion of the mold and is presented to a robot for removal. Suitably placed ejector push rods facilitate removal of the casting. It is well known in the art that the process of part removal can be done with various automated machines such as robot devices. The cavity inserts molding surfaces are conditioned for the next casting cycle by applying suitable means of mold release or mold lubricant by automatic means.

The present invention has several advantages over the prior art. The arrangement of processing cylinder and shooting pot adjacent to one another in the same physical block of material offers a number of advantages compared with the prior art. Firstly, heat is effectively transferred from the heaters through the block to the shooting pot. Additional heaters are not required to maintain the shooting pot temperature as they are in a thixomolding machine. Also, the additional wall thickness of the cylinder provides improved resistance to cracking of the inner wall of the shooting pot due to the high internal stresses at that location. Also, any minor leaks from the high-pressure area of the shooting pot cannot escape directly into the environment as in a thixomolding machine, the leakage simply returns to the low-pressure chamber of the processing cylinder. Furthermore, the overall dimension of this cylinder arrangement is extremely compact compared with the prior art. In addition, the vertical orientation of the device ensures that the liquid or semi-solid material being processed does not contaminate the solid portion of the feed material when the machine is not in operation. Also, the multiple processing cylinders offer increased surface area for conduction of heat to the feedstock. Further, the diameter of these cylinders can be independently dimensioned to that of the shooting pot, unlike a typical thixomolding machine where the cylinder is one diameter. And finally, this compact, single block construction is less expensive to manufacture than the equivalent functional assemblies of hot-chamber die casting or thixomolding machines.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

Therefore, what is claimed is:

1. A casting machine for casting parts in a mold out of a metal using a metal feedstock, the machine comprising:

a. a thermally conductive block, being a unified cylindrical block having at least one processing cylinder and an injector cylinder;

b. each processing cylinder being formed in said thermally conductive block, said processing cylinder having a processing chamber and opposite first and second ends;

c. a particulate feedstock feed housing to hold particulate feedstock, said feed housing having an outlet connected to the first end of the processing cylinder being configured to transfer particulate feedstock from the feed housing to the first end of the processing cylinder;

d. said injector cylinder formed in said thermally conductive block adjacent the processing cylinder, so as to have a common wall extending along said cylinders between said processing cylinder and said injector cylinder, from the opposite first to second ends, and thereby be thermally connected thereto;

e. a shooting pot formed at one end of said injector cylinder and coupled to the second end of the processing cylinder by a passage within said thermally conductive block configured to permit feedstock to pass from the processing cylinder into the shooting pot;

f. a nozzle coupled to the injector cylinder to transfer material from the shooting pot to the mold;

g. a processing drive for driving the feedstock from the first end of the processing cylinder through the passage into the shooting pot;

h. a coaxially-placed heater thermally coupled to the thermally conductive block to transfer heat to the processing cylinder, and through said common wall, extending from the opposite first to second ends, to said injector cylinder and to the shooting pot, the heater and processing cylinder configured to supply heat to the feed stock such that the feedstock becomes progressively more liquid as it passes from the first to the second end of the processing cylinder; and i. an injector plunger coupled to an injector actuator for driving the plunger sufficiently to force the metal from the shooting pot through the nozzle and into the mold.

2. The casting machine of claim 1 wherein said thermally conductive block includes a plurality of processing cylinders surrounding the injector cylinder, wherein said processing cylinder and said injector cylinder are in thermal communication over the full length of the injector cylinder.

3. The casting machine of claim 2 wherein each of the processing cylinders are coupled to the passage.

4. The casting machine of claim 3 wherein the passage has a volume greater than the shooting pot.

5. The casting machine of claim 4 wherein the processing drive comprises a processing plunger for each processing cylinder coupled to a processing actuator configured to drive the processing plungers in the processing cylinders between the first and second ends of the processing cylinders.

6. The casting machine of claim 5 wherein the processing drive further comprises a first member operatively coupled to a processing actuator to each of the processing plungers, and a first member of the processing actuator operatively connected to a first member of the processing plungers.

7. The casting machine of claim 6 further comprising a distributor for distributing the feedstock from a hopper into each of the processing cylinders, the distributor comprising an annular member rotatably mounted to the block adjacent the first ends of the processing cylinders, the annular member having a plurality of fingers dimensioned to spread the feedstock among the processing cylinders, the annular member having a plurality of passages to permit the processing plungers to pass there through, the processing plunger drive being further configured to withdraw the plungers from the processing cylinders and away from the annular member to permit the annular member to rotate relative to the processing cylinders.

8. The casting machine of claim 2 further comprising a distributor for distributing the feedstock from a hopper into each of the processing cylinders.

9. The casting machine of claim 8 further comprising a distributor for distributing the feedstock from a hopper into each of the processing cylinders, the distributor comprising an annular member rotatably mounted to the block adjacent the first ends of the processing cylinders, the annular member having at least one finger dimensioned to spread the feed stock among the processing cylinders as the annular member rotates.

10. The casting machine of claim 1 wherein the processing drive comprises a processing plunger coupled to a processing actuator configured to drive the processing plunger in the processing cylinder between the first and second ends of the processing cylinder.

11. The machine of claim 1 wherein the thermally conductive block is insulated, directing heat radially to said processing cylinder and said injector cylinder.

12. The casting machine of claim 1 further comprising a mold cooler for removing heat from the mold, the mold cooler configured to transfer a portion of the heat removed from the mold to the feedstock before the feedstock enters the processing cylinder.

13. A device for casting a part in a mold comprising a plurality of casting machines as defined in claim 1 coupled to said mold, wherein processing cylinders and injector cylinders of the casting machines are operatively connected to the mold, the mold being disposed below the injector cylinders, such that gravity causes a liquid phase of the processing stock to flow into the mold.

14. A casting machine for casting parts in a mold out of a metal feedstock, the casting machine comprising;

a. a thermally conductive block, the block being a cylindrical block having a plurality of processing cylinders and an injector cylinder;

b. said plurality of processing cylinders each having opposite first and second ends formed in the thermally conductive block, the first end to receive the feedstock;

c. the block being thermally coupled to a coaxially placed heater, wherein the heater, block and each processing cylinder are configured to supply heat to feedstock introduced in particulate solid state into said processing cylinder, said heater supplying heat through said block to elevate the temperature of said feedstock, whereby said feedstock becomes progressively more liquid as it passes from the first to the second end of the processing cylinder;

d. said injector cylinder formed in the block adjacent said processing cylinders, and having a common wall extending along and between said cylinders from the opposite first to second ends, so as to be thermally connected to said heater, the injector cylinder having a shooting pot and an injector plunger coupled to a nozzle, the shooting pot being coupled to the second end of each of the feedstock processing cylinders by a passage including a valve configured to permit the one way movement of heated feedstock from the processing cylinder into the shooting pot, the injector plunger configured to inject the heated feedstock through the nozzle into the mold.

15. The casting machine of claim 14 further comprising a processing drive for urging the feedstock through the processing cylinders, the processing drive comprising a processing plunger for each processing cylinder, the processing plungers coupled to a processing actuator for moving the processing plungers between the first and second ends of the processing cylinder.

16. The casting machine of claim 15 further comprising a distributor for distributing the feedstock from a hopper into each of the processing cylinders, the distributor comprising at least one finger movably mounted to the block adjacent the first ends of the processing cylinders, and further comprising a finger actuator for moving the finger sufficiently to spread the feedstock among the processing cylinders.

17. The casting machine of claim 16 further comprising a cap mounted onto the thermally conductive block adjacent the first ends of the processing cylinders, the cap configured to permit the processing and injector plungers to pass there through, the thermally conductive block having a mounting plate adjacent the mold and further comprising a compression actuator coupled to the cap and mounting plate for keeping the cap, the block and the mounting plate in compression.

18. A machine for molding a part out of a feedstock, said device comprising:

a. a mold having a plurality of mold portions, each mold portion configured to mold a different portion of the part;

b. a plurality of molding units, each molding unit being coupled to one of said portions for molding said portion;

c. each molding unit comprising a thermally conductive cylindrical block with at least one processing cylinder and an injector cylinder formed therein, said processing cylinder having opposite first and second ends, the first end configured to receive the feedstock;

d. the block being thermally coupled to a coaxially-placed heater, wherein the heater, block and processing cylinder are configured to supply heat to the feedstock such that the feedstock becomes progressively more liquid as it passes from the first to the second end of the processing cylinder;

e. said injector cylinder formed in the block adjacent the processing cylinder and having a common wall with the processing cylinder extending from the opposite first to second ends, the injector cylinder having a shooting pot, an injector plunger and a nozzle, the nozzle being coupled to the mold portion, the shooting pot being coupled to the second end of the feedstock processing cylinder by a passage configured to permit the movement of heated feedstock from the processing cylinder into the shooting pot, the injector plunger configured to inject the heated feedstock through the nozzle and into the mold.

19. The machine of claim 18 wherein the molding units each comprise a plurality of processing cylinders formed in the block and surrounding the injector cylinder, each of the processing cylinders being coupled to the passage.

20. The machine of claim 19 wherein the molding units each further comprise a processing drive for urging the feedstock through the processing cylinders, the processing drive comprising a processing plunger for each processing cylinder, the processing plungers coupled to a processing actuator for moving the processing plungers between the first and second ends of the processing cylinder.

21. The machine of claim 20 wherein the molding units each further comprise a distributor for distributing the feedstock from a hopper into each of the processing cylinders, the distributor comprising at least one finger movably mounted to the block adjacent the first ends of the processing cylinders, and further comprising a finger actuator for moving the finger sufficiently to spread the feedstock among the processing cylinders.

* * * * *